US007117840B2

(12) United States Patent
Schapiro et al.

(10) Patent No.: US 7,117,840 B2
(45) Date of Patent: Oct. 10, 2006

(54) ROTARY PISTON MACHINE WITH AN OVAL ROTARY PISTON GUIDED IN AN OVAL CHAMBER

(76) Inventors: Boris Schapiro, Schloβstraβe 30, 12163 Berlin (DE); Lev Levitin, 11 Monmouth Ct., apt. 1, Brookline, MA (US) 02146

( * ) Notice: Subject to any disclaimer, the term of this patent is extended or adjusted under 35 U.S.C. 154(b) by 0 days.

(21) Appl. No.: 11/212,496

(22) Filed: Aug. 26, 2005

(65) Prior Publication Data

US 2006/0032475 A1 Feb. 16, 2006

Related U.S. Application Data

(63) Continuation of application No. PCT/EP04/01921, filed on Feb. 26, 2004.

(30) Foreign Application Priority Data

Feb. 27, 2003 (DE) ..... 103 08 831

(51) Int. Cl.

| | |
|---|---|
| ***F01C 21/00*** | (2006.01) |
| ***F01C 19/02*** | (2006.01) |
| ***F01C 21/10*** | (2006.01) |
| ***F01C 1/08*** | (2006.01) |
| ***F01C 1/10*** | (2006.01) |
| ***F01C 1/22*** | (2006.01) |
| ***F01C 1/02*** | (2006.01) |
| ***F01C 1/00*** | (2006.01) |
| ***F02B 53/04*** | (2006.01) |
| ***F02B 53/00*** | (2006.01) |

(52) U.S. Cl. ..... 123/204; 123/241; 418/61.2

(58) Field of Classification Search ..... 123/204, 123/241; 418/61.2, 61.3

See application file for complete search history.

(56) References Cited

U.S. PATENT DOCUMENTS

| | | | | |
|---|---|---|---|---|
| 3,117,563 | A | 1/1964 | Wiegert | 418/61.2 |
| 3,760,777 | A * | 9/1973 | Leroy et al. | 418/61.3 |

(Continued)

FOREIGN PATENT DOCUMENTS

| | | | |
|---|---|---|---|
| DE | 28 53 930 | A | 6/1980 |

(Continued)

*Primary Examiner*—Sheldon J Richter
(74) *Attorney, Agent, or Firm*—Lawrence G. Fridman, Esq.

(57) ABSTRACT

A rotary piston machine with a housing forming a prismatic cavity with a cavity wall. The cross section of the prismatic cavity is a cavity oval. A rotary piston is guided for rotary movement in the cavity. The rotary piston moves in consecutive intervals of motion from one blocking position to an adjacent end position. The rotary piston, during the consecutive intervals of motion rotates, in the same rotational direction, alternatingly about one of two different axes. A transmission arrangement transmits the rotary motion about two axes. When the rotary piston reaches a blocking position, there is an associated larger diameter cavity circular arc, in which the larger diameter piston circular arc was slidingly guided during the preceding interval of motion. To provide unambiguous kinematics of the system in this position, there is a device for temporarily providing, when said rotary piston has reached one of the blocking positions, reduced rotary speed of the rotary motion of said rotary piston about that one of the axes which is located in the center of curvature of the associated larger radius circular arc, as compared to the rotary speed about the other axis. Variable volume working chambers are defined between the wall of the cavity and the rotary piston. For sealing between these working chambers, sealing ledges with sealing surfaces are provided.

6 Claims, 10 Drawing Sheets

U.S. PATENT DOCUMENTS 3,799,705 A * 3/1974 Gunthard ..... 418/61.2
3,875,905 A * 4/1975 Duquette ..... 418/61.2
3,884,600 A * 5/1975 Gray ..... 418/61.2
3,967,594 A * 7/1976 Campbell ..... 418/61.3
3,996,901 A * 12/1976 Gale et al. ..... 418/61.3
4,141,126 A * 2/1979 Okada ..... 418/61.2
4,597,725 A * 7/1986 Petersen et al. ..... 418/61.3
5,370,508 A * 12/1994 Barthod et al. ..... 418/61.3
6,158,992 A * 12/2000 Morita ..... 418/61.2

FOREIGN PATENT DOCUMENTS

DE 19920289 C1 * 7/2000
FR 1 327 607 A 12/1963
JP 53 028810 A 3/1978
LU 45663 A 3/1964

* cited by examiner

ROTARY PISTON MACHINE WITH AN OVAL ROTARY PISTON GUIDED IN AN OVAL CHAMBER

This application is a continuation of currently pending in International application No. PCT/EP2004/001921 filed Feb. 26, 2004 which claims priority of German Patent Application No 103 08 831.8 filed Feb. 27, 2003.

BACKGROUND OF THE INVENTION

The invention relates to a rotary piston machine of the type having a housing, a prismatic cavity in the housing, the cross section of this cavity being an oval, and a rotary piston movable in this cavity, the cross section of this rotary piston being also an oval, the order of the rotary piston oval being different from the order of the oval forming the cross section of the cavity. The rotary piston, in operation, moves, in consecutive intervals of motion, from one blocking position to the next. In each such blocking position, the axis about which the rotary piston rotates, changes from one position to another one. Thus the rotary piston, alternatingly, rotates about different axes of rotation. During this rotary movement, two working chambers are defined between the inner wall of the cavity and the rotary piston, the volume of one working chamber increasing, while the volume of the respective other working chamber decreases. The rotary piston has an axial aperture therethrough with an internal gear, which meshes with gear means for driving the rotary piston machine or for being driven thereby.

In mathematics, an "oval" is a non-analytical, closed, convex figure which is composed of circular arcs. The circular arcs join each other continuously and differentially. In the points in which the circular arcs join, the curve is continuous. Also the tangents of the two joining circular arcs coincide there. The curve is differentiable. In the points, where the circular arcs of different radii of curvature join, the second derivative, which determines the curvature, makes a saltus. The oval consists, alternatingly, of circular arcs having a first, smaller radius of curvature and a second, larger radius of curvature. The order of the oval is determined by the number of pairs of circular arcs having the first and second radii of curvature. An oval of second order or bi-oval is "ellipse-like" with two diametrically opposite circular arcs of smaller diameter and two circular arcs of larger diameter.

Rotary piston machines of this type are known.

U.S. Pat. Nos. 3,967,594 and 3,996,901 disclose rotary piston machines having an oval rotary piston in an oval cavity. The cross section of the rotary piston is bi-oval. This bi-oval rotary piston is movable in a tri-oval chamber. In this prior art rotary piston machine, complex transmissions are provided to transmit the rotary movement of the rotary piston to an output shaft.

DE 199 20 289 C1 describes a rotary piston machine, wherein the cross section of a prismatic cavity defined in a housing is tri-oval with three pairs of continuously and differentially joining first and second circular arcs of alternatingly a smaller radius of curvature and a larger radius of curvature. A rotary piston having bi-oval cross section is guided in this cavity. The bi-oval cross section of the rotary piston is formed of alternatingly first and second circular arcs with the smaller and larger, respectively, radii of curvature of the tri-oval cross section of the cavity, these circular arcs, again, joining continuously and differentially. The bi-oval rotary piston, in the cavity, carries out the intervals of motion with "jumping" instantaneous axes of rotation described above. The rotary movement of the rotary piston is picked-off in a very simple way: A shaft extends centrally through the tri-oval cavity, i.e. along the line of intersection of the planes of symmetry of the cavity. The shaft carries a pinion. The rotary piston has an oval aperture with an internal gear. The long axis of the cross section of the aperture extends along the short axis of the bi-oval cross section of the rotary piston. The pinion continuously meshes with the internal gear.

In the prior art rotary piston machine, a housing defines a prismatic cavity, the cross section of which is such an oval of odd order, thus, for example, an oval of third order. The cavity has cylindrical inner wall sections with, alternatingly, the first, smaller and the second, larger radii of curvature. In such an oval of third (fifth or seventh or higher) order, rotary piston is rotatable, the cross section of which is an oval, the order of this rotary piston oval being by one smaller than the order of the oval of the cavity. Even though the oval used for the rotary piston has a higher order, it has a twofold symmetry, i.e. it is mirror-symmetrical with respect to two mutually orthogonal axes. This rotary piston has two diametrically opposite cylindrical surface sections, the radius of curvature of which is equal to the smaller (first) radius of curvature of the oval of the cavity. If the cross section of the rotary piston is an oval, the second, larger radius of curvature of this oval is equal to the second, larger radius of curvature of the oval defining the cavity. In a certain interval of motion, a first of these cylindrical surface sections of the rotary piston engages a cylindrical inner wall section complementary thereto of the cavity, which inner wall section has the same radius of curvature. The second, diametrically opposite cylindrical surface section of the rotary piston slides along the opposite, larger radius of curvature cylindrical inner wall section of the cavity. In this way, two working chambers are defined by the rotary piston, of which, during the rotation of the rotary piston, one increases in volume and one becomes smaller. In this interval of motion, the rotary piston rotates about an instantaneous axis of rotation. This instantaneous axis of rotation coincides with the cylinder axis of the first cylindrical surface section. This instantaneous axis of rotation has a well-defined position relative to the rotary piston. In this interval of motion, the instantaneous axis of rotation coincides, of course, also the housing-fixed cylinder axis of the smaller radius of curvature inner wall section, in which the rotary piston rotates. This rotation continues, until the second cylindrical surface section of the rotary piston reaches a blocking position. In the blocking position, the second cylindrical surface section engages the smaller diameter inner wall section joining the opposite inner wall section of larger diameter.

A further rotation of the rotary piston about the hitherto existing instantaneous axis of rotation is not possible. Therefore, the instantaneous axis of rotation, for the next interval of motion, "jumps" into another position, namely the cylinder axis of the second cylindrical surface section. Also this new instantaneous axis of rotation is in a well-defined position relative to the rotary piston. In the next interval of motion, this instantaneous axis of rotation coincides with the cylinder axis of the cylindrical inner wall section, in which now the second cylindrical surface section of the rotary piston is rotatably guided. In this interval of motion, the "first" cylindrical surface section slides along the opposite inner wall section of lager radius of curvature.

In a rotary piston machine of this type, the rotary piston rotates always with the same rotational direction but, alternatingly, about different instantaneous axes of rotation, the axes of rotation "jumping" after each interval of motion. Referenced to the rotary piston, two such instantaneous axes of rotation are defined, namely by the cylinder axes of the diametrically opposite cylindrical surface sections. Referring to the housing and the cavity defined therein, the instantaneous axis of rotation jumps between the "corners" of the oval. Thus, the cylinder axes of the inner wall sections having smaller radii of curvature.

During each interval of motion, the volume of one working chamber increases up to a maximum value, while the volume of the respective other working chamber decreases down to a minimum value. In the ideal case, when the cross section of the rotary piston also is an oval, the volume of the working chamber increases from virtually zero to the maximum value and decreases to virtually zero, respectively. Such a rotary piston machine can be designed as a two stroke or four stroke internal combustion engine or as an engine with external combustion such as a steam engine. It may, however, also be designed to operate as a pneumatic motor, as a hydraulic motor or as a pump.

DE 199 20 289 C1 discloses rotary piston machine, wherein a rotary piston, the cross section of which is an oval of second order, is movable in a cavity, the cross section of which is an oval of third order. For transmitting the movement of the rotary piston, there is a single output shaft extending centrally through the cavity. The output shaft extends through an oval aperture of the rotary piston and carries a pinion. The pinion is in mesh with an internal gear on the inner wall of the aperture.

In the prior art rotary piston machine, the order of the oval defining the cavity is always by one larger than the order of the oval defining the cross section of the rotary piston. A bi-oval rotary piston is guided in a tri-oval cavity. In the blocking positions, the instantaneous axes of rotation of the rotary piston jump relative to the rotary piston between two positions, but jump between at least three positions relative to the housing. The smaller radius section of the rotary piston moves translatorily along the larger radius inner wall section of the cavity. This may cause sealing problems with the sealing between the working chambers. A further problem results from the fact that, in each working cycle, consecutively more than two working chambers is formed, which travel around along the inner wall of the housing.

A similar design is disclosed in applicants' U.S. patent application Ser. No. 10/773,093, filed Aug. 8, 2002 (=WO 03/014527). For ensuring that the kinematics of the instantaneous axis of rotation is unambiguously defined in the blocking positions, one rotational axis is temporarily fixed by mechanical means, in such blocking position.

Luxembourg patent 45,663 to Bleser, filed Mar. 16, 1964 and granted Mar. 30, 1965, describes an internal combustion engine in the form of a rotary piston engine, wherein a housing has an oval cavity and the cross section of the rotary piston is also an oval, wherein, however the order of the oval of the cavity is smaller than the order of the oval of the rotary piston. Thus the cross section of the cavity is an oval of second order, while the cross section of the rotary piston is an oval of third order. Two working chambers are defined between the inner wall of the cavity and the rotary piston. When the rotary piston rotates, the volume of one of the chambers increases, while the volume of the respective other one of the chambers is reduced. The rotary piston rotates always in the same rotary direction but in consecutive intervals of motion from one blocking position to the next blocking position. When the rotary piston has reached one blocking position by rotating about a first axis of rotation, it rotates further to the next blocking position about a second axis of rotation. With this structure, there are two housing-fixed axes of rotation, and the rotary piston, in consecutive intervals of motion, alternatingly rotate about these two axes.

To transmit the rotary motion of the rotary piston, the rotary piston has an aperture therethrough, which forms an oval similar to the contour of the rotary piston. This aperture forms an internal gear.

Two spaced, parallel shafts extend through the aperture. The axes of the shafts coincide with the two axes, about which the rotary piston rotates alternatingly. Pinions are provided on the shafts and mesh with the internal gear of the aperture.

SUMMARY OF THE INVENTION

It is an object of the invention to improve the seal between the working chambers of the cavity.

It is a further object of the invention to ensure, in a rotary piston machine of the type mentioned above, unambiguous kinematics with unambiguous movements of the rotary piston in the blocking positions of the rotary piston.

A more specific object of the invention is to reduce the number of the instantaneous axes of rotation occurring referenced to the housing.

A still further object of the invention is to design a rotary piston machine of the type mentioned above such that only two working chambers are defined, which are opposite each other in fixed angular positions and the volumes of which increase and decrease alternatingly.

To this end, in accordance with one aspect of the invention, a rotary piston machine comprises a housing defining a prismatic cavity with a cavity wall therein, the cross section of said prismatic cavity being a cavity oval which is formed by circular arcs of, alternatingly, smaller and larger radii, an order of said an order of said cavity oval being defined by a first number of pairs of said smaller radius and larger radius circular arcs. A rotary piston is guided for rotary movement in said cavity and has a cross section which is also an oval formed by circular arcs of, alternatingly, said smaller and larger radii, an order of said piston oval being defined by a second number of pairs of said smaller radius and larger radius circular arcs. Said order of said cavity oval is by one smaller than the order of said piston oval. Said rotary piston moves in consecutive intervals of motion from one blocking position, in which a pair of said smaller and larger radii circular arcs of said rotary piston engage a pair of smaller and larger radii, respectively, circular arcs of said cavity, to an adjacent end position, in which another pair of said smaller and larger radii circular arcs of said rotary piston engage a pair of smaller and larger radii, respectively, circular arcs of said chamber. Said rotary piston, during said consecutive intervals of motion rotating, in the same rotational direction, alternatingly about one of two different axes, said axes are located, relative to said cavity, in the centers of curvature of said larger radius circular arcs. In each such interval of motion one larger radius circular arc of said rotary piston slides along a larger radius circular arc of said chamber while a smaller radius circular arc of said rotary piston engages an opposite larger radius circular arc of said chamber. Transmission means are provided for transmitting rotary motion about said two axes. Thereby, when said rotary piston reaches a blocking position, there is an associated larger diameter cavity circular arc, in which the larger diameter piston circular arc was slidingly guided during the preceding interval of motion. Means are provided for temporarily providing, when said rotary piston has reached one of said blocking positions, reduced rotary speed of the rotary motion of said rotary piston about that one of said axes which is located in the center of curvature of said associated larger radius circular arc, as compared to the rotary speed about the other axis.

In the locking position, the kinematics of the rotary piston in the cavity is not unambiguous. Instead of a further rotary movement, transverse forces could occur, for example by feeding a fluid under pressure into the volume-minimized working chamber or by igniting a fuel mixture. Such transverse forces could result in jamming of the rotary piston in the chamber. In order to solve this problem and to obtain unambiguous kinematics, means are provided for reducing, when a blocking position has been reached, the rotary motion of said rotary piston about that one of said axes which is located in the center of curvature of said associated larger radius circular arc, as compared to the rotary speed about the other axis. This forced speed reduction ensures that the rotary piston continues to rotate about the axis which is thus forced to rotate at a lower speed. This forced selection of rotary speed need only take place for a short time, until the rotary piston has rotated out of the blocking position. The forced reduction of rotary speed can be effected in that braking means temporarily brake a respective one of the two axes. This can be achieved quite easily.

On one side, a peripheral section of the rotary piston rotates rather slowly along a peripheral section of the inner wall of the cavity having large radius of curvature. The slower movement reduces the sealing problems. On the opposite side, a peripheral section of the rotary piston slides with large radius of curvature on a large radius of curvature peripheral section of the inner wall. This results in a large sealing surface The two shafts meshing with the internal gear rotate alternatingly at lower and higher rotary speed. By means of a differential gear or a free wheel, a constant rotary speed of a driving or driven shaft coupled with both shafts can be provided.

According to another aspect of the invention, a rotary piston machine comprises a housing defining a prismatic cavity therein, the cross section of said prismatic cavity being a cavity oval which is formed by circular arcs of, alternatingly, smaller and larger radii, an order of said an order of said cavity oval being defined by a first number of pairs of said smaller radius and larger radius circular arcs. A rotary piston is guided for rotary movement in said cavity and has a cross section which is also an oval formed by circular arcs of, alternatingly, said smaller and larger radii, an order of said piston oval being defined by a second number of pairs of said smaller radius and larger radius circular arcs. Said order of said chamber oval being different from the order of said piston oval. Said rotary piston and said cavity define blocking positions in which said smaller diameter circular arc of said rotary piston closely engages one of said smaller diameter circular arcs of said cavity and an adjacent one of said larger diameter circular arcs of said rotary piston closely engages an adjacent one of said larger diameter circular arcs of said cavity, movement of said rotary piston from one of said blocking positions to the next one defining intervals of motion. Said rotary piston, during said consecutive intervals of motion rotates, in the same rotational direction, alternatingly about different axes. Thereby, variable volume working chambers are defined between said cavity wall and said rotary piston. For sealing between said working chambers, sealing ledges with sealing surfaces are provided, the radius of curvature one of said sealing surfaces being equal to said smaller radius of curvature and the radius of curvature of another one of said sealing surfaces being equal to said larger radius of curvature.

This ensures surface sealing engagement with both types of curved surfaces.

In accordance with a third aspect of the invention, an internal combustion engine is provided having at least one working chamber limited by a piston and means for fuel injection, wherein said fuel injection means are arranged in a separate ignition chamber communicating with said working chamber, and means for tuning said ignition chamber and fuel injected by said fuel injection means such that substantially only burnt, expanding combustion gas enters the working chamber.

Embodiments of the invention are described hereinbelow with reference to the accompanying drawings.

DESCRIPTION OF THE PREFERRED EMBODIMENT

Figure 1:
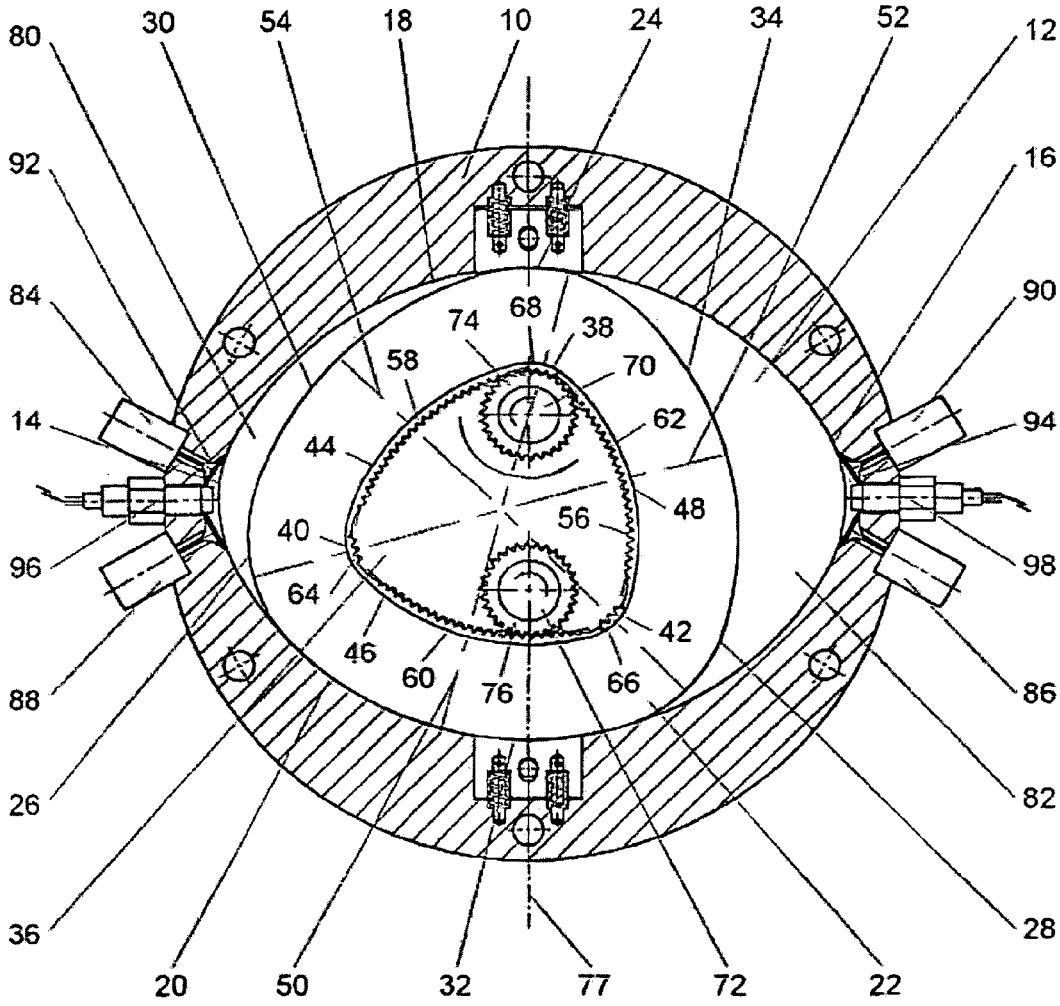
FIG. 1 shows a cross sectional view of a rotary piston machine having two shafts, wherein a rotary piston, the cross section of which is an oval of third order, is guided in a cavity, the cross section of which is an oval of second order.

Referring to FIG. 1, numeral 10 designates a housing. A cavity 12 is defined in this housing 10. The cross section of the cavity represents an oval of second order or is "bi-oval". Thus the cross section of the cavity is formed by two circular arcs 14 and 16 of relatively small radius of curvature and, alternating therebetween, two circular arcs 18 and 20 of relatively large radius of curvature. The circular arcs join continuously and differentially.

A rotary piston 22 is guided in cavity 12. The cross section of the rotary piston 22 represents an oval of third order or is "tri-oval". Accordingly, the circumference of the cross section consists of three pairs of circular arcs, each pair comprising a circular arc of relatively small radius of curvature 24, 26 and 28, respectively, and a circular arc of relatively large radius of curvature 30, 32 and 34, respectively. The circular arcs of small and large radii of curvature join alternatingly and also continuously and differentially. The small radii of curvature of the rotary piston 22 are equal to the small radii of curvature of the cavity 12, and, in the same way, the large radii of curvature of the rotary piston 22 are equal to the large radii of curvature of the cavity 12. The cross section of the cavity 12 looks similar to an ellipse. The cross section of the rotary piston looks similar to a triangle of arcs with rounded corners.

The rotary piston 22 has a central aperture 36. The cross section of the aperture 36 represents also an oval of third order. This oval of third order is composed of three circular arcs of relatively small radii of curvature 38,40 and 42 and of three circular arcs of relatively large radii of curvature. The circular arcs 38, 40 and 42 having small radii of curvature and the circular arcs 44,46 and 48 having large radii of curvature join alternatingly and continuously and differentially, whereby an oval similar to a triangle of arcs with rounded corners is formed. The planes of symmetry 50, 52 and 54 of the aperture 36 coincide with the planes of symmetry of the rotary piston 22.

The aperture 36 has an internal gear 56. This internal gear 56 has three concave-arcuate gear racks 58, 60 and 62 substantially along the circular arcs 44, 46 and 48, respectively. Between these concave-arcuate gear racks 58, 60 and 62, convex-arcuate (or straight) gear racks 64, 66 and 68 are provided in the region of the circular arcs of small radius of curvature.

Two parallel shafts 70 and 72 with pinions 74 and 76, respectively, extend through the aperture 36. The axes of the shaft are located in the plane of symmetry 77, extending through the circular arcs 18 and 20, of the cavity 12. The pinion of one shaft, in FIG. 1 the pinion 74 of shaft 70, is located in the "corner of the triangle of arcs", i.e. in the region of the circular arc 38 of small radius of curvature and meshes with the internal gear 56, as will be described below. The pinion of the other shaft, in FIG. 1 pinion 76 of shaft 72, meshes with the opposite concave-arcuate gear rack, in FIG. 1 the gear rack 60.

The rotary piston 22 subdivides the bi-oval cavity 12 into two working chambers 80 and 82. In FIG. 1, the rotary piston machine is illustrated schematically as an internal combustion engine. Accordingly, an inlet valve 84 or 86 and an outlet valve 88 or 90 is shown for each working chamber 80 and 82, respectively. Furthermore, a combustion chamber 92 or 94 with a spark plug or a fuel injector 98 and 98 communicates with each working chamber 80 and 82, respectively. The working chambers 80 and 82 with the valves and spark plugs or fuel injectors are arranged symmetrical to the plane of symmetry passing through the circular arcs 14 and 16 of small radii of curvature.

Pairs of adjacent sealing ledges 100A and 100B and 102A and 102B are provided in the regions 18 and 20, respectively, of large radii of curvature. The sealing ledges 100A and 100B and 102A and 102B, respectively, are symmetrical to the plane of symmetry passing through the circular arcs 18 and 20 of large radii of curvature of the cross section.

Figure 7A:
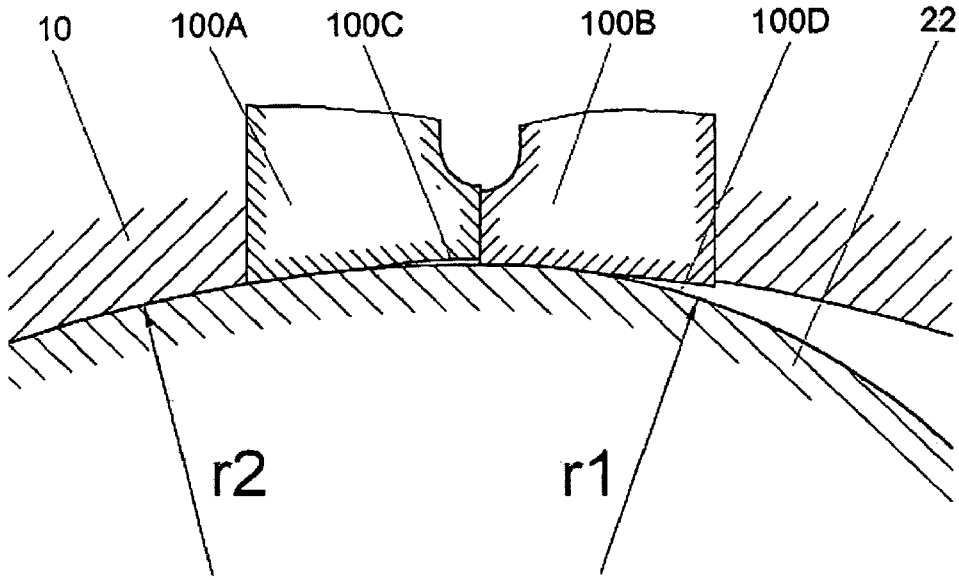
FIG. 7A is a schematic enlarged illustration of a seal used in a rotary piston machine of the type illustrated in FIGS. 1 to 5, sealing being effected between a sealing ledge and a surface section of the rotary piston having the smaller radius of curvature.

FIG. 7A shows the sealing ledges 100A and 100B with a position in the area of the transition from the small radius of curvature $r_1$ of the outer surface of the rotary piston 22, on the right in FIG. 7A, to the area of the larger radius of curvature $r_2$ of this outer surface, on the left in FIG. 7A. The sealing ledge 100A has a concave-cylindrical inner surface, the radius of curvature of which is equal to the larger radius of curvature $r_2$. The sealing ledge 100B has a concave-cylindrical inner surface, the radius of curvature of which corresponds to the smaller radius of curvature $r_1$. It will be apparent, that the inner surface of the sealing ledge 100A closely engages the surface of the rotary piston complementary thereto, in the area of the radius of curvature $r_2$. In the area, in which the radius of curvature of the surface of the rotary piston is smaller, namely $r_1$, a wedge-shaped gap 100C is formed between the inner surface of the sealing ledge 100A and the rotary piston 22. The sealing ledge 100B has a concave-cylindrical inner surface, the radius of curvature is equal to the smaller radius of curvature $r_1$. It will be apparent, that the inner surface of the sealing ledge 100B closely engages the surface of the rotary piston 22 complementary thereto, in the area of the radius of curvature $r_1$ of the rotary piston 22. In the area, in which the radius of curvature of the surface of the rotary piston 22 is larger, namely $r_2$, a wedge-shaped gap 100D is formed between the sealing ledge 100B and the rotary piston 22. In the transition region illustrated, both sealing ledges, on a respective portion of the inner surface, are in surface contact with the outer surface of the rotary piston, whereby a surface-to-surface seal is ensured.

Figure 7B:
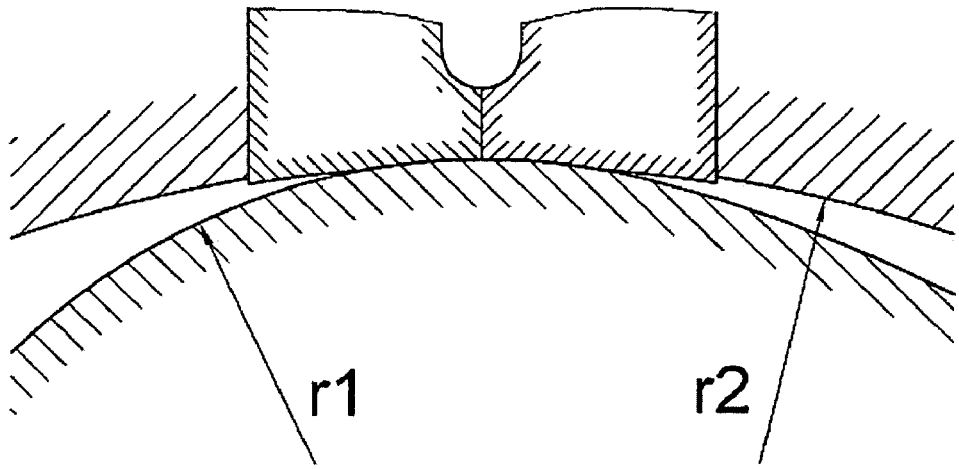
FIG. 7B is a schematic enlarged illustration of a seal used in a rotary piston machine of the type illustrated in FIGS. 1 to 5, sealing being effected between a sealing ledge and a surface section of the rotary piston having the larger radius of curvature.

FIG. 7B shows, in similar manner, the seal in the area of the transition from the large radius of curvature $r_2$ to the smaller radius of curvature $r_1$. When the pair of sealing ledges 100A and 100B engages an area of the rotary piston having large radius of curvature $r_2$ only or an area having small radius of curvature $r_1$ only, either the sealing ledge 100A or the sealing ledge 100B ensures a surface contact with its respective total inner surface.

The described arrangement operates as follows:

The rotary piston 22 rotates counter-clockwise in FIG. 1. When doing so, the rotary piston 22 rotates about the shaft 70 and slides with low speed along the inner wall of the cavity 12 in the area of the large radius of curvature. The axis of the shaft 70 passes through the center of curvature of the circular arc 24 of smaller radius of curvature. The circular arc 24 is tangent to the circular arc 18 of the cross section of the cavity 12. The opposite area of the outer surface of the rotary piston 22 with large radius of curvature engages the area of the inner wall of the cavity 12 corresponding to the circular arc 20. This area of the inner wall has the same radius of curvature as the engaging area of the outer surface of the rotary piston. Thus, there is a shape-adapted surface-to surface engagement. During the rotary movement of the rotary piston, this area of the outer surface of the rotary piston slides along the corresponding area of the inner wall.

Thereby, the volume of the working chamber 80 is increased, while the volume of the working chamber 82 becomes smaller. During this process, the shaft 70 is rotated relatively slowly, while a relatively fast rotation of the shaft 72 occurs.

Figure 2:
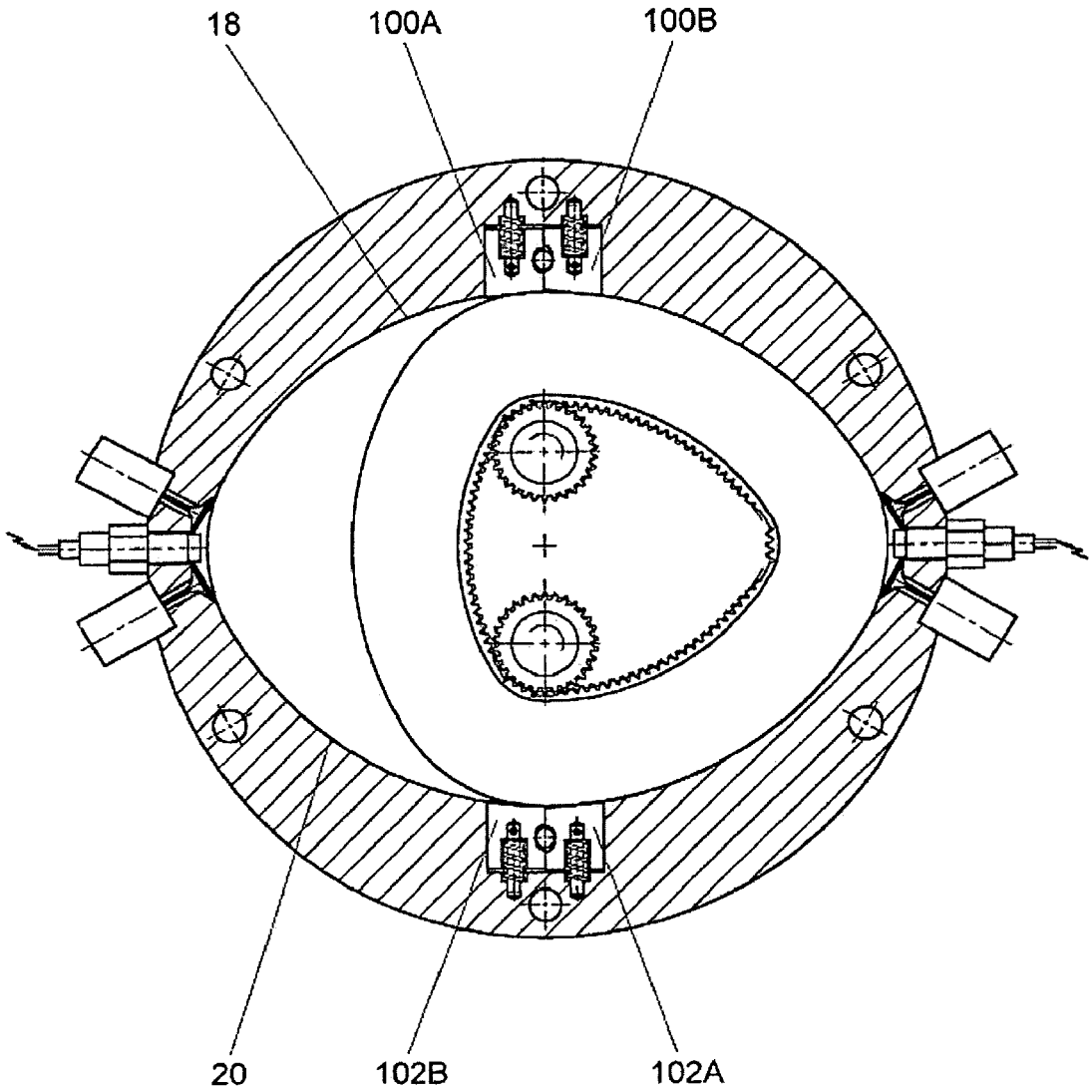
FIG. 2 is an illustration similar to FIG. 2 and shows the rotary piston in a blocking position.

This movement is continued, until the right blocking position in FIG. 2 is reached. Then the area of the outer surface of the rotary piston is located in that area of the inner wall of cavity 12, which corresponds to the circular arc 16. Both areas have the same, namely the small radius of curvature. The areas of the outer surface of the rotary piston corresponding to the circular arcs 32 and 34 having the large radius of curvature engage that areas of the inner wall of cavity 12, which correspond to the circular arcs 18 and 20, respectively, of the cross section. These radii of curvature, again, are equal. Thus the volume of the working chamber 82, apart from the combustion chamber 82, is reduced to zero, while the working chamber 82 has its maximum volume. Then the shaft 72 with the pinion 76 is located in the region which corresponds to the circular arc 40, thus, so to say, in the left lower "corner" of the triangle of arcs. The rotary piston 22 is, however, not able to further rotate about the shaft 70 as instantaneous axis of rotation.

This position is illustrated in FIG. 2.

For a further rotation, which may, for example, be effected by igniting fuel in the combustion chamber 94 in an internal combustion engine or by conducting a working fluid into the working chamber 82, the instantaneous axis of rotation "jumps" to the axis of shaft 72. The rotary piston 22 can now continue to rotate counter-clockwise, but now about the shaft 72.

The further motion sequence is then, referenced to the new instantaneous axis of rotation, the same as described before with reference to the shaft 70 as instantaneous axis of rotation.

Figure 3:
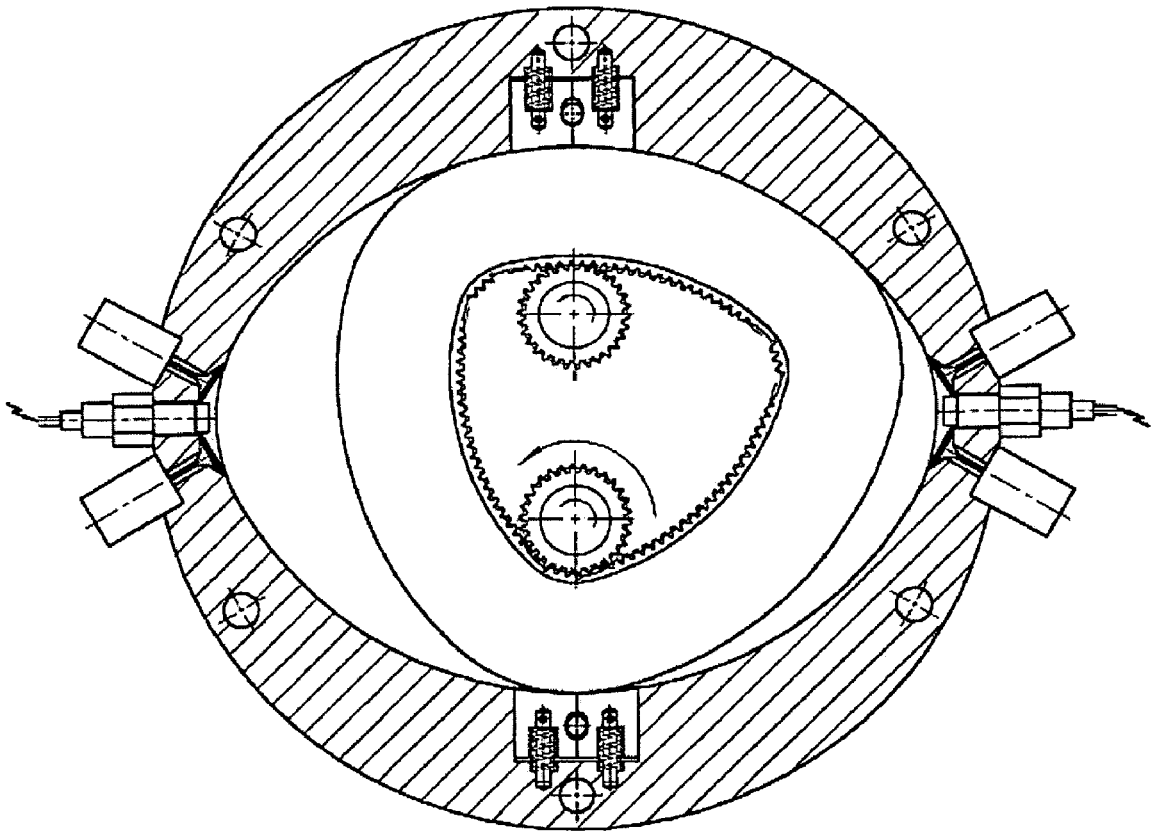
FIG. 3 is an illustration similar to FIG. 2 and shows the rotary piston during the next interval of motion.

Consecutive intervals of motion occur, when the rotary piston 22 rotates. Each interval of motion extends from one of the described blocking positions to the next one. In each interval of motion, the volume of one working chambers, for example 80, increases from zero to a maximum, while the volume of the other working chamber decreases from the maximum down to zero. During the next interval of motion, it is the other way round: The volume of the working chamber 82 increases from zero (FIG. 2) up to a maximum, while the volume of the working chamber 80 decreases again (FIG. 3).

In the position of FIG. 2, the kinematics is not unambiguous. Each of the two shafts could with its axis define an instantaneous axis of rotation. If then, for example, by working fluid conducted into the working chamber 82, a force to the left is exerted on the rotary piston 22, this force could result in a translatory motion in horizontal direction instead of a rotary motion about an instantaneous axis of rotation. Thereby, the rotary piston 22 would be wedged in the cavity 12.

This risk can be avoided in that, in the position of FIG. 2, rotary speed regulating means are used to temporarily compel a lower rotary speed of the shaft 72 than the rotary speed of shaft 70. Then the rotary piston is forced to rotate about this shaft 72, while the other shaft 70 permits the concave-arcuate gear rack to roll off on the pinion 74.

Figure 6:
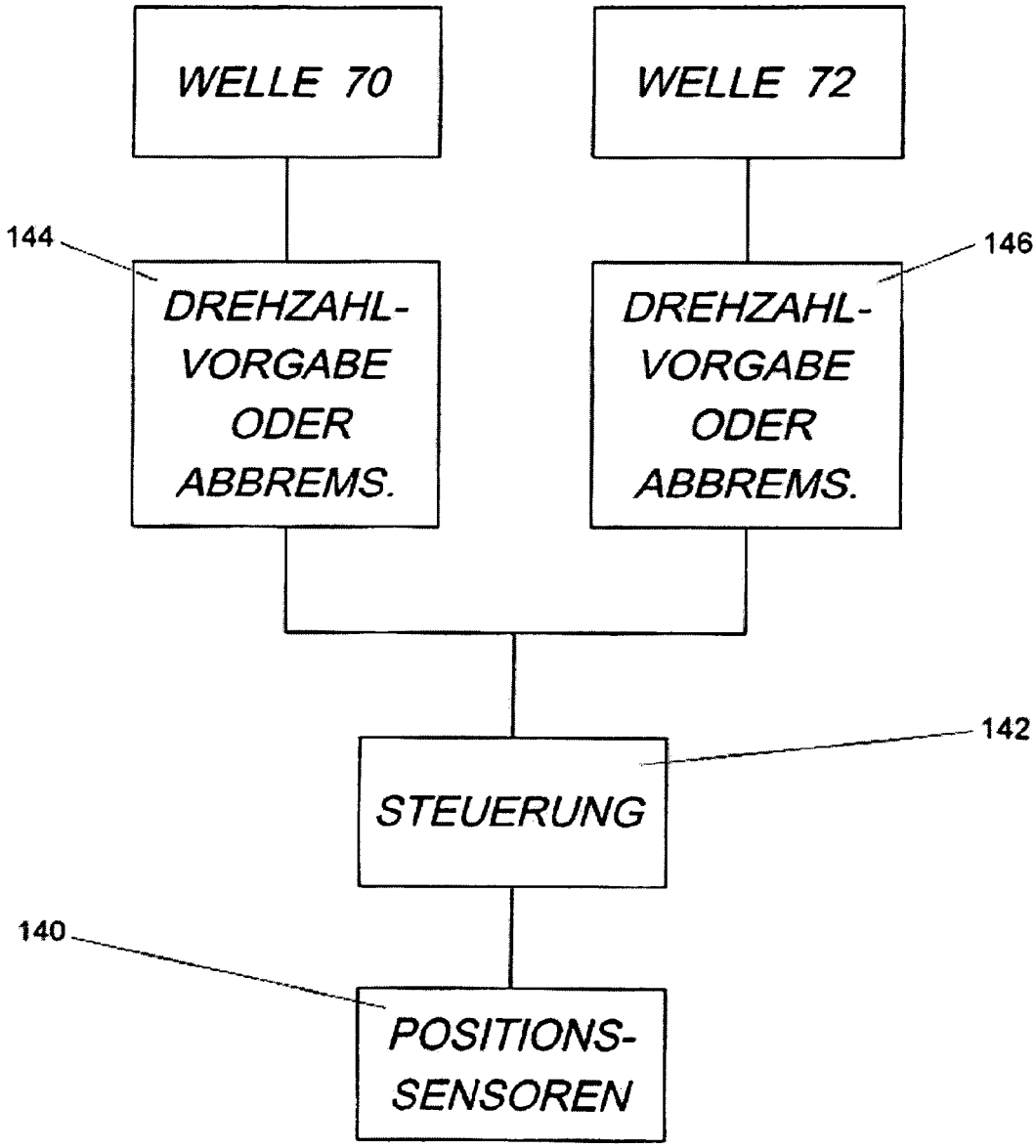
FIG. 6 is a schematic illustration of rotary speed regulating means used in a rotary piston machine of FIG. 1.

This is schematically illustrated in FIG. 6. Sensors 140 detect the position of the rotary piston 22 in the cavity 12. The sensors signal when the rotary piston has reached a blocking position. Then a control device 142, to which the signals from the sensors are applied, actuates devices 144 and 146 by which, alternatingly, depending on which blocking position had been reached, rotary speeds are temporarily, for a short time, rotary speeds are forced on shaft 70 or shaft 72, respectively, For example, a lower rotary speed is forced on shaft 70, and a higher rotary speed is forced on shaft 72 or vice versa. In the simplest case, these devices 144 and 146 may be braking devices which, in the blocking positions, are caused to act, alternatingly for a short time, on the shaft 70 or the shaft 72, while the respective other shaft remains unbroken.

The radii of the reference circles of the pinions are substantially equal to the small radii of curvature of the oval of second order defining the aperture 36. If the internal gear 56 followed the oval of the aperture continuously, then the pinions would be caught, each time, in the blocking positions of the rotary piston 22. The "corners" of the "triangle of arcs" could not roll over the pinions. For this reason, the concave-arcuate gear racks are interconnected, in the region of the circular arcs 38, 40, 42 of smaller radii of curvature, are interconnected by short straight or convex-arcuate gear racks 64, 66 or 68, respectively. The convex-arcuate gear racks 64, 66 and 68 permit the internal gear 56, and thereby the rotary piston 22, to continue its rotation. They are so dimensioned that, in each blocking position, one of the concave-arcuate gear racks 58, 60 or 62 engages the pinion 74 or 76 immediately after the pinion 74 or 76 has disengaged the preceding gear rack 62, 58 or 60, respectively. In this way, each pinion continuously engages one of the concave-arcuate gear racks 64, 66 or 68. The short convex-arcuate or straight gear racks ensure transition without interrupting the form fit but also without blocking.

Figure 4:
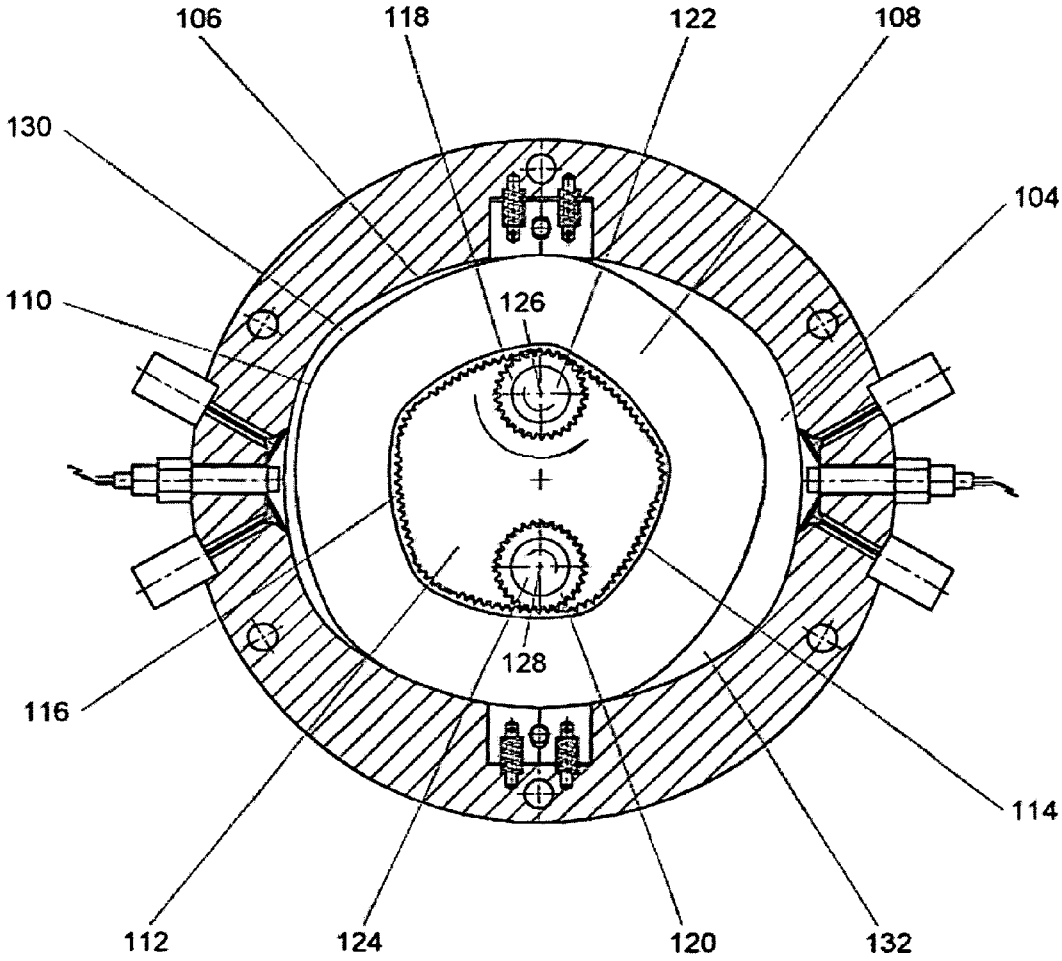
FIG. 4 shows a cross sectional view of a rotary piston machine having two shafts, wherein the rotary piston, the cross section of which is an oval of fifth order, is guided in a cavity, the cross section of which is an oval of fourth order.

FIG. 4 shows a rotary piston machine having a cavity, the cross section of which represents an oval 106 of fourth order. A rotary piston 108, the cross section of which represents an oval 110 of fifth order is guided in the cavity 108. Also here, the rotary piston 108 has an aperture 112, the shape of which represents an oval 114 of fifth order. The axes of symmetry of rotary piston 108 and aperture coincide. The aperture has an internal gear 116. The internal gear 116 meshes with two pinions 118 and 120. The pinions 118 and 120 are attached to two housing-fixed shafts 122 and 124, respectively. The axes 126 and 128 of the shafts 122 and 124, respectively extend in an axis of symmetry of the cavity 104.

The rotary piston 108 subdivides the cavity into two working chambers 130 and 132, of which, when the rotary piston rotates, alternatingly the volume of one is increased and the other one is decreased.

The operating cycle is similar to the operating cycle of the embodiment of FIGS. 1 to 3. The rotary piston 108 rotates, for example, about the axis 126 of one shaft 122 up to a blocking position. Then the instantaneous axis of rotation jumps into the axis 128 of the other shaft 124. The rotary piston continues to rotate counter-clockwise in FIG. 4 up to the next blocking position. Course of motion between two consecutive blocking positions is an "interval of motion". In each interval of motion, the volume of the working chamber 130 increases from zero to a maximum and the volume of the working chamber 132 decreases from a maximum to zero, or vice versa. The working chambers are located always on both sides of the plane of symmetry containing the axes 126 and 128. They do not travel around the cavity.

In FIG. 4, valves and spark plugs or fuel injectors are (schematically) shown for each working chamber.

Figure 4A:
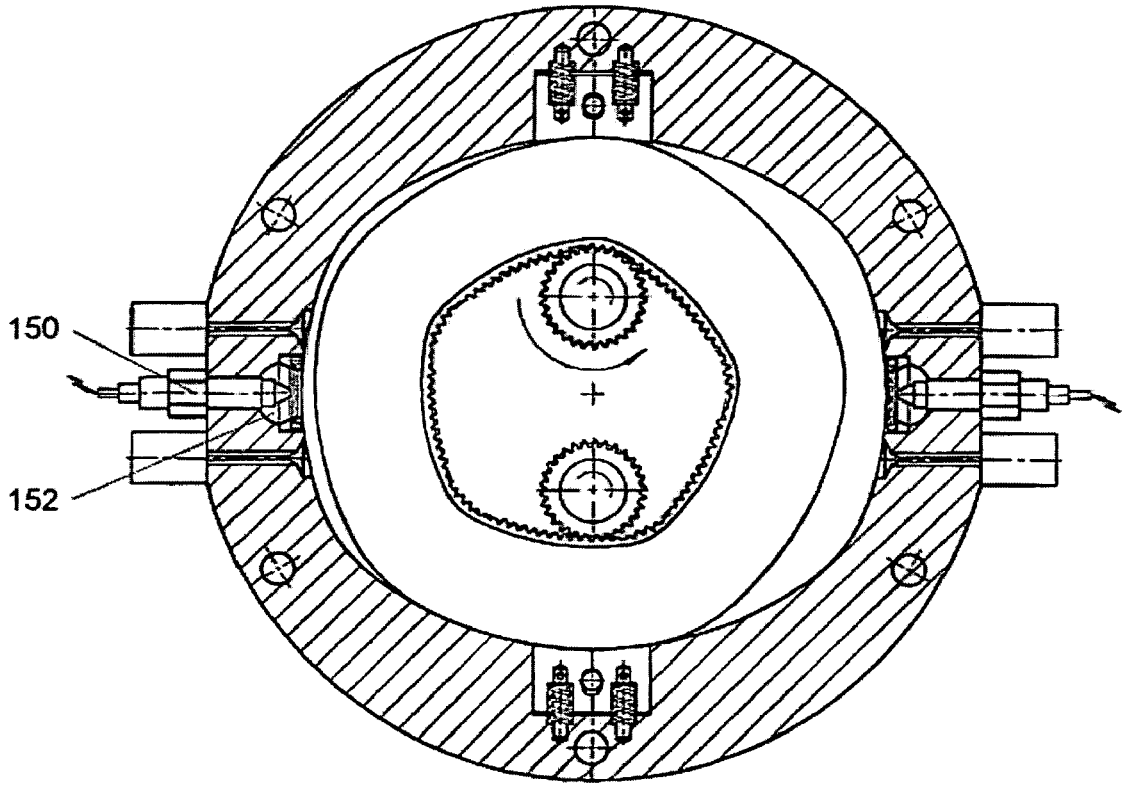
FIG. 4A shows a modification of the arrangement of FIG. 4.

FIG. 4A shows a rotary piston machine similar to FIG. 4. Corresponding elements bear the same reference numerals as there. Details of the rotary piston machine of FIG. 4A are shown, at an enlarged scale, in FIGS. 8 and 8A.

In the rotary piston machine of FIG. 4A, numeral 150 designates a fuel injector. The fuel injector extends into a combustion chamber. This combustion chamber is so dimensioned and shaped, that the injected fuel is combusted substantially in the combustion chamber only. Then only the expanding combustion gases emerge into the expanding working chamber. The injection may be metered time-dependent or dependent on the rotation of the rotary piston such that it is adapted to the change of volume of the working chamber 130 or 132. There is no flame front within the working chamber. The propagation of flame fronts in an expanding working chamber presents problems in prior art rotary piston machines.

Figure 8:
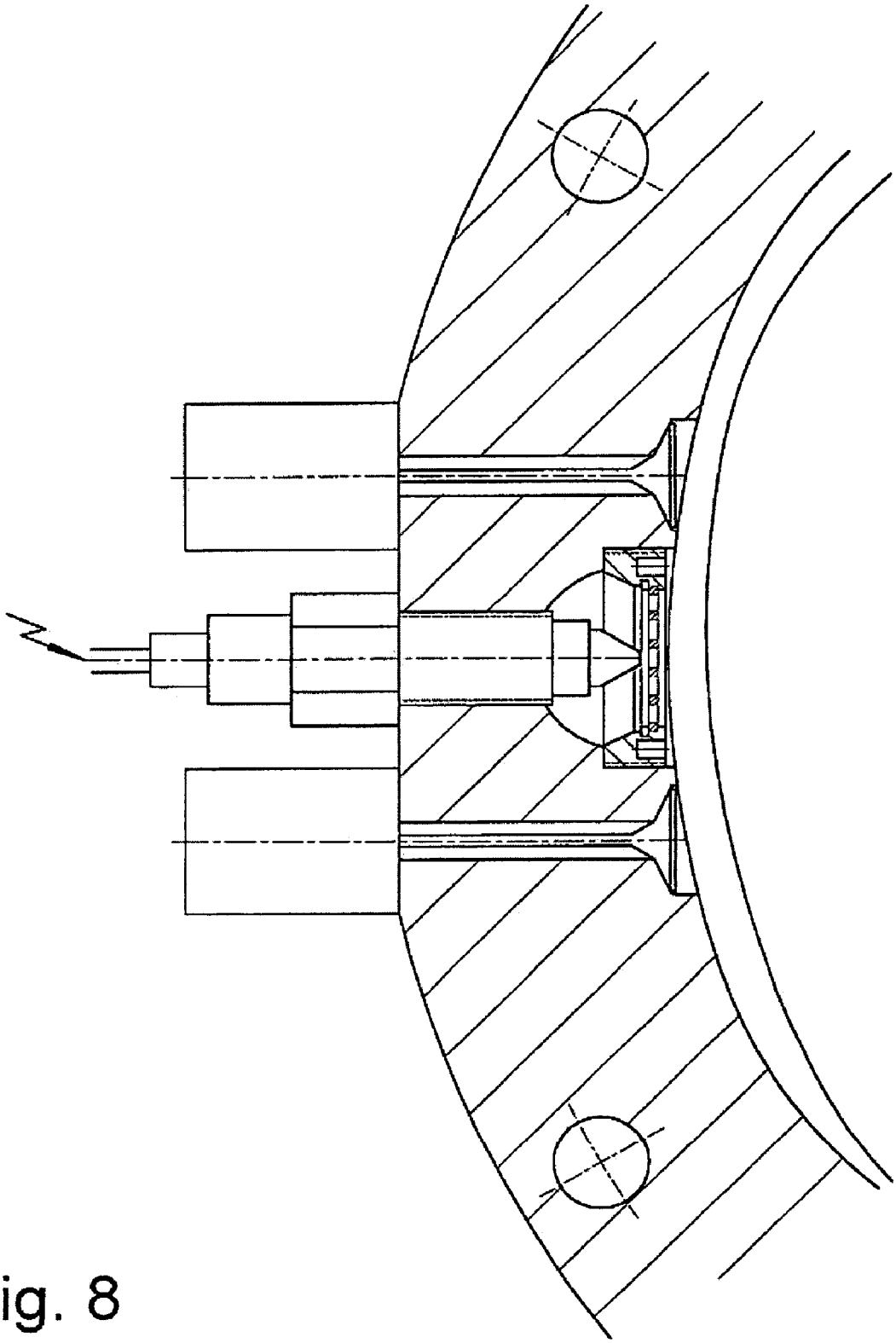
FIG. 8 shows, at an enlarged scale, a detail of the rotary piston machine of FIG. 4A.
Figure 8A:
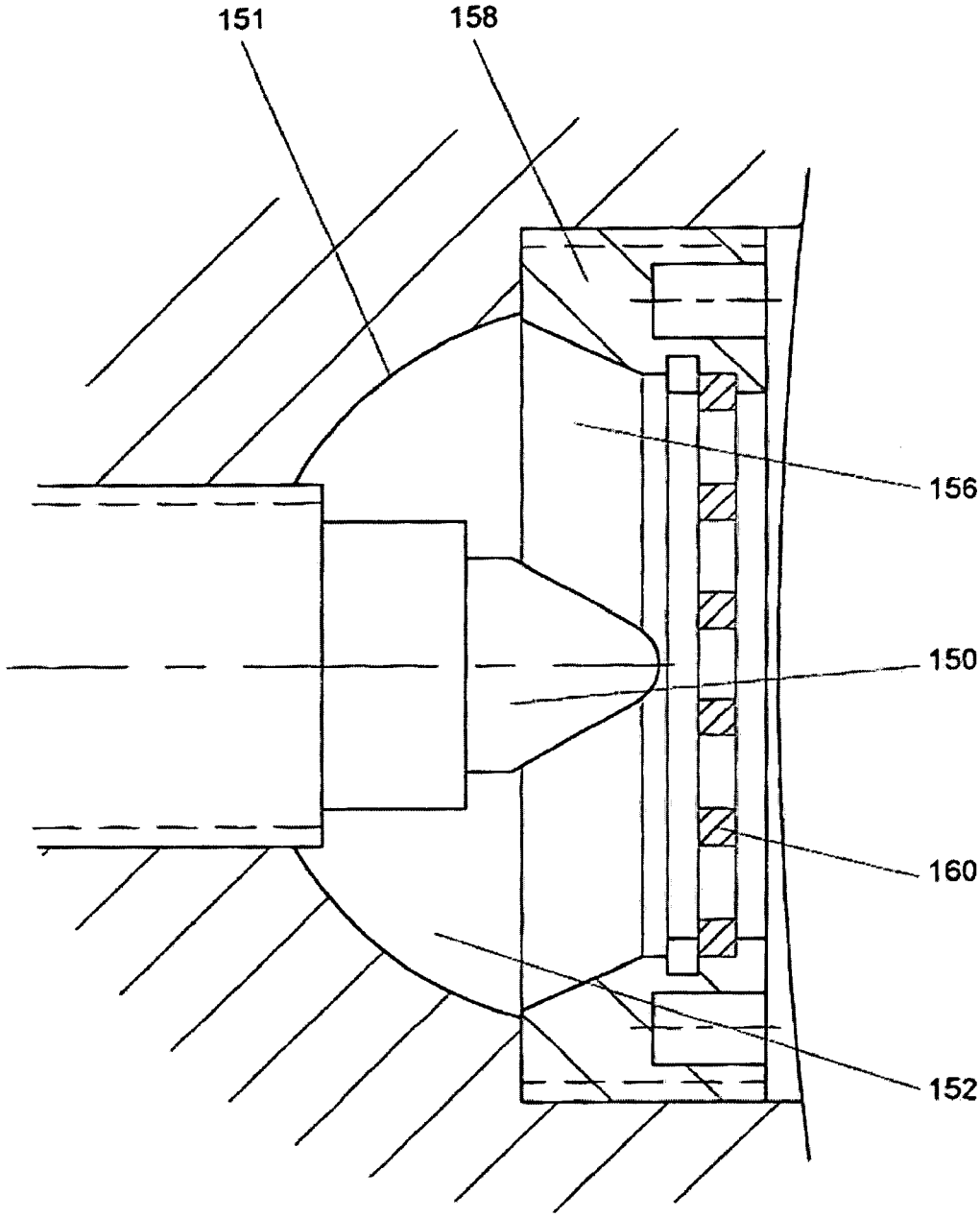
FIG. 8A shows the detail of FIG. 8 at a further enlarged scale.

In the embodiment of FIGS. 8 and 8A, the combustion chamber comprises a spherical calotte-shaped recess of the housing, which communicates with a first conical space 156 tapering towards the working chamber. The space 156 is formed in an insert 158, which is screwed in a threaded recess of the wall of the working chamber 130 or 132. The combustion chamber 152 is closed by a grid or net 160. The fuel injector 150 terminates in a cone rounded at the tip, injection taking place through nozzle openings in the surface of this cone.

The described arrangement of the fuel injector in a combustion chamber such that combustion takes place substantially within the combustion chamber and frame fronts in the working chambers are avoided, is also applicable to other machines, for example in reciprocating internal combustion engines.

Figure 5:
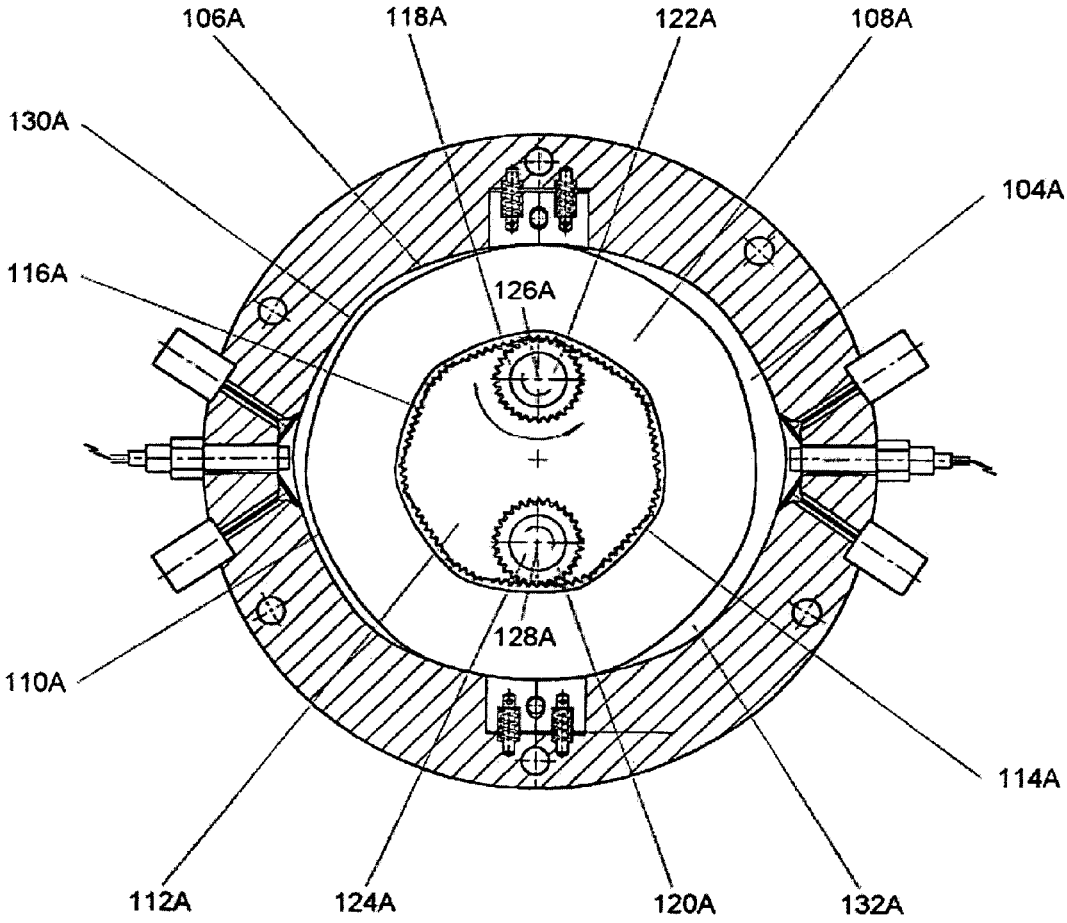
FIG. 5 shows a cross sectional view of a rotary piston machine having two shafts, wherein a rotary piston, the cross section of which is an oval of seventh order, is guided in a cavity, the cross section of which is an oval of sixth order.

FIG. 5 shows a rotary piston machine, wherein a rotary piston, the cross section of which represents an oval of seventh order, is guided in a cavity the cross section of which represents an oval sixth order. Setup and operation are, apart from the orders of the ovals, similar to that of the embodiment of FIG. 4. Corresponding elements are designated by the same reference numerals as in FIG. 4, however marked by the suffix "A".

The invention claimed is:

1. A rotary piston machine comprising:

a housing defining a prismatic cavity with a cavity wall therein, the cross section of said prismatic cavity being a cavity oval which is formed by circular arcs of, alternatively, smaller and larger radii, an order of said cavity oval being defined by a first number of pa smaller radius and larger radius circular arcs, a rotary piston guided for rotary movement in said cavity and having a cross section which is also an oval formed by circular arcs of, alternatively, said smaller and larger radii, an order of said piston oval being defined by a second number of pairs of said smaller radius and larger radius circular arcs, said order of said cavity oval being by one smaller than the order of said piston oval, said rotary piston moving in consecutive intervals of motion from one blocking position, in which a pair of said smaller and larger radii circular arcs of said rotary piston engage a pair of smaller and larger radii, respectively, circular arcs of said cavity, to an adjacent end position, in which another pair of said smaller and larger radii circular arcs of said rotary piston engage a pair of smaller and larger radii, respectively, circular arcs of said cavity, said rotary piston, during said consecutive intervals of motion rotating, in the same rotational direction, alternatively about one of two different axes, said axes being located, relative to said cavity, in the centers of curvature of said larger radius circular arcs, in each such interval of motion one larger radius circular arc of said rotary piston sliding along a larger radius circular arc of said cavity, while a smaller radius circular arc of said rotary piston engages an opposite larger radius circular arc of said cavity, transmission means for transmitting rotary motion about said two axes, whereby, when said rotary piston reaches a blocking position, there is an associated larger diameter cavity circular arc, in which the larger diameter piston circular arc was slidably guided during the preceding interval of motion, and means for temporarily providing, when said rotary piston has reached one of said blocking positions, reduced rotary speed of the rotary motion of said rotary piston about that one of said axes which is located in the center of curvature of said associated larger radius circular arc, as compared to the rotary speed about the other axis.

2. A rotary piston machine as claimed in claim 1, wherein said reduced rotary speed providing means comprises means for compelling said reduced rotary speed.

3. A rotary piston machine as claimed in claim 1, wherein said reduced rotary speed providing means comprise means for braking said rotation of said rotary piston about said axis which is located in the center of curvature of said associated larger radius circular arc.

4. A rotary piston machine comprising:

a housing defining a prismatic cavity therein, the cross section of said prismatic cavity being a cavity oval which is formed by circular arcs of, attentively, smaller and larger radii, an order of said cavity oval being defined by a first number of pairs of said smaller radius and larger radius circular arcs, a rotary piston guided for rotary movement in said cavity and having a cross section which is also an oval formed by circular arcs of, alternatively, said smaller and larger radii, an order of said piston oval being defined by a second number of pairs of said smaller radius and larger radius circular arcs, said order of said chamber oval being different from the order of said piston oval, said rotary piston and said cavity defining blocking positions in which said smaller diameter circular arc of said rotary piston closely engages one of said smaller diameter circular arcs of said cavity and an adjacent one of said larger diameter circular arcs of said rotary piston closely engage an adjacent one of said larger diameter circular arcs of said cavity, movement of said rotary piston from one of said blocking positions to the next one defining intervals of motion, said rotary piston, during said consecutive intervals of motion rotating, in the same rotational direction, alternatively about different axes, whereby variable volume working chambers are defined between said cavity wall and said rotary piston, wherein, for sealing between said working chambers, sealing ledges with sealing surfaces are provided, the radius of curvature one of said sealing surfaces being equal to said smaller radius of curvature and the radius of curvature of another one of said sealing surfaces being equal to said larger radius of curvature.

5. A rotary piston machine as claimed in claim 4, wherein said sealing ledges are retained in said cavity wall and said sealing surfaces are concave.

6. A rotary piston machine as claimed in claim 4, wherein said sealing ledges are provided in pairs of separate, adjacent sealing ledges, of which one has a radius of curvature equal to said smaller radius of curvature and the other one has a radius of curvature equal to said larger radius of curvature.

* * * * *